US006427559B2

(12) United States Patent
Junkers

(10) Patent No.: US 6,427,559 B2
(45) **Date of Patent: *Aug. 6, 2002**

(54) UNIVERSAL POWER TOOL

(76) Inventor: John K. Junkers, 8 Stonewall Rd., Saddle River, NJ (US) 07458

( * ) Notice: Subject to any disclaimer, the term of this patent is extended or adjusted under 35 U.S.C. 154(b) by 0 days.

This patent is subject to a terminal disclaimer.

(21) Appl. No.: 09/862,805

(22) Filed: May 22, 2001

Related U.S. Application Data

(63) Continuation-in-part of application No. 09/338,616, filed on Jun. 23, 1999, now Pat. No. 6,260,444.

(51) Int. Cl.[7] ..... B25B 13/46
(52) U.S. Cl. ..... 81/57.39; 81/57.13
(58) Field of Search ..... 81/57.13, 57.14, 81/57.29, 57.3, 57.39

(56) References Cited

U.S. PATENT DOCUMENTS 5,203,238 A * 4/1993 Ferguson ..... 81/57.39
5,448,930 A * 9/1995 Miner et al. ..... 81/57.39
6,260,444 B1 * 7/2001 Junkers ..... 81/57.39

* cited by examiner

*Primary Examiner*—James G. Smith
(74) *Attorney, Agent, or Firm*—Michael J. Striker

(57) ABSTRACT

A universal power tool has at least two interchangeable first housing units, at least two interchangeable second housing units, one of the at least two first housing units having a first axis and a cam mechanism to be turned by an outside power source, the other of the at least two first housing units having a cylinder-piston arrangement with a piston rod movable by fluid power, each of the at least two second housing units having a second axis perpendicular to the first axis, a lever, ratchet mechanism, different engaging structures for engaging a threaded connector to be tightened or loosened, and also having a third axis perpendicular to the first axis and to the second axis, and a structure for interchangeably connecting one of the at least two second housing units to one of the at least two first housing units, so that upon rotating the cam of the one of the at least two first housing units in one direction the cam mechanism imparts a movement along the first axis, and upon moving a piston of the other of the at least two first housing units a piston rod imparts a movement along the first axis, each of the movements along the first axis being applied to the lever-ratchet mechanism to make one end of a lever to move along the first axis and another end of the lever to turn around the third axis, and thereby when the cam is turned by an outside tool or the piston rod is moved along the first axis by fluid power, the lever-ratchet mechanism is moved forward and backward to ratchet the fastener in a single turning direction.

4 Claims, 6 Drawing Sheets

UNIVERSAL POWER TOOL

CROSS REFERENCE TO A RELATED APPLICATION

This application is a continuation-in-part of application Ser. No. 09/338,616, filed Jun. 23, 1999 now U.S. Pat. No. 6,260,444.

BACKGROUND OF THE INVENTION

The present invention relates to power tools for tightening and loosening threaded connectors.

More particularly, it relates to such power tools which have engaging means for engaging the threaded connector to be tightened and loosened, a ratchet mechanism for turning the engaging means so as to turn a threaded connector engaged by the latter, and a drive which acts on the ratchet means to turn the ratchet means together with the engaging means and thereby to turn the threaded connector. Such power tools are known in the art, as disclosed for example in U.S. Pat. Nos. 5,054,047; 5,029,497; RE 33951; 5,953,966; 4,346,630; 5,953,966.

There are many applications which have different requirements to the power tools of this type. In some applications a customer requires a high torque accuracy, in other applications the customer seeks a high torque output, in further applications the customer prefers more side and overhead clearance to use a limited clearance tool. It is therefore advisable to provide a power tool which can satisfy various sometimes contradictory requirements of applications.

It is also known, for example from U.S. Pat. No. 5,953,966, the lever-ratchet mechanism and a linkage of the drive connected in the same housing, so that with each different nut size a different housing, linkage and lever mechanism is necessary, making it very expensive for the end user. In addition, by incorporation of the lever mechanism and the linkage of the drive in the same housing, the tool is not suited for other torque augmenting mechanisms, which in turn limits the tool use.

SUMMARY OF THE INVENTION

Accordingly, it is an object of the present invention to provide a power tool which can satisfy different requirements of applications.

In keeping with these objects and with others which will become apparent hereinafter, one feature of the present invention resides, briefly stated, in a power tool which has two interchangeable first housing units; two interchangeable second housing units, one of said two first housing units having a first axis and a cam mechanism to be turned by an outside power source, the other of said two first housing units having a cylinder-piston arrangement with a piston rod movable by fluid power, each of said [at least] two second housing units having a lever-ratchet mechanism, and different engaging means for engaging a threaded connector to be tightened or loosened and having a second axis perpendicular to said first axis; and means for interchangeably connecting one of said two second housing units to one of said two first housing units, so that upon rotating said cam mechanism of said one of said two first housing units in one direction said cam mechanism impart a movement along said first axis, and upon moving a piston of said other of said two first housing units a piston rod imparts a movement along said first axis, each of said movements along said first axis is applied to said lever-ratchet mechanism to make one end of a lever to move along said first axis and another end of said lever to turn around said second axis, and thereby when said cam is turned by an outside tool or said piston rod is moved along said first axis with fluid power, said lever-ratchet mechanism is moved forward and backward to ratchet the fastener in a single turning direction.

In the power tool in accordance with the present invention the torque augmenting means are separated from the torque output means in a disconnectable manner, so as to either add different sized torque output means for different nut sizes to the torque augmenting means or to add different torque augmenting means to a particularly sized torque output means. Therefore the cost for the end user is drastically decreased. Since one housing can be used with different other housings, a new power tool eliminates all limitations of the prior art and provides the end user with a truly universal power wrench.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
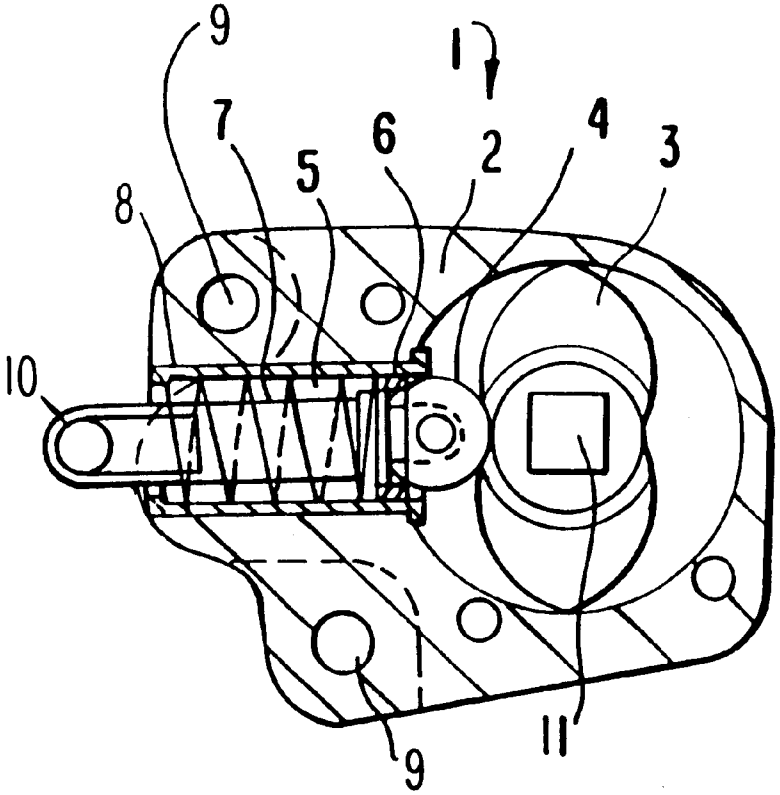
FIGS. 1 and 2 are a side view and an end view of one first unit of a power tool in accordance with the present invention.
Figure 2:
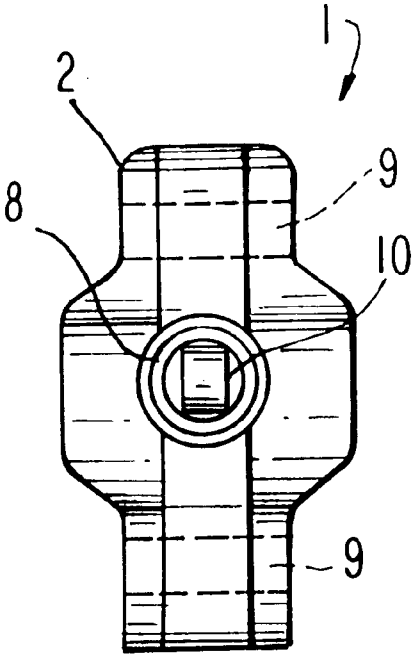
Figure 3:
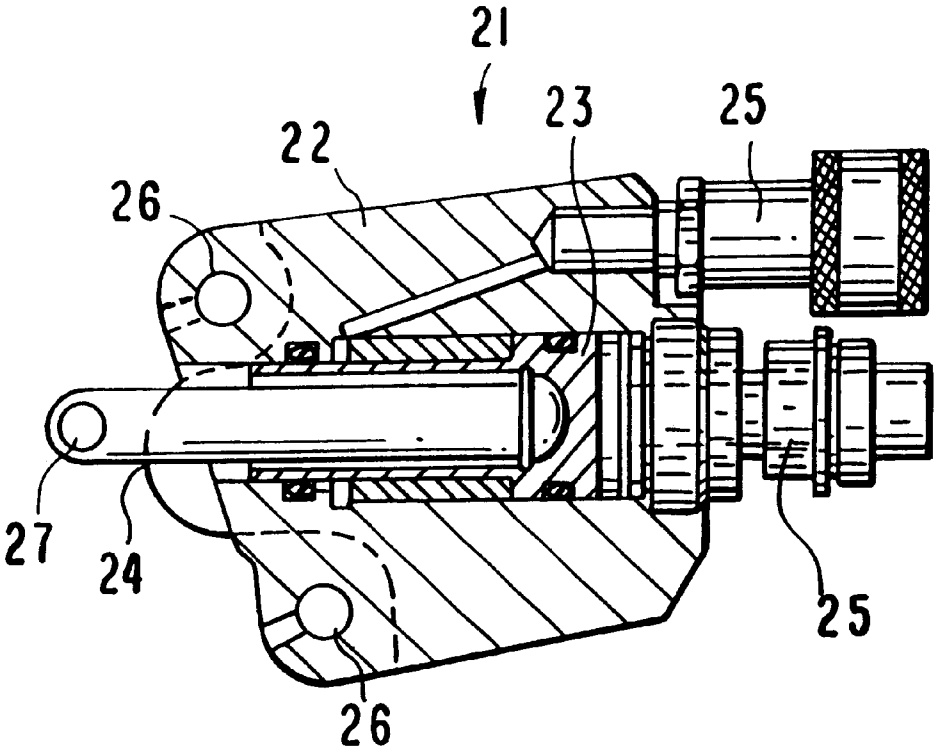
FIGS. 3 and 4 is a side view and an end view of another first unit of the inventive power tool.
Figure 4:
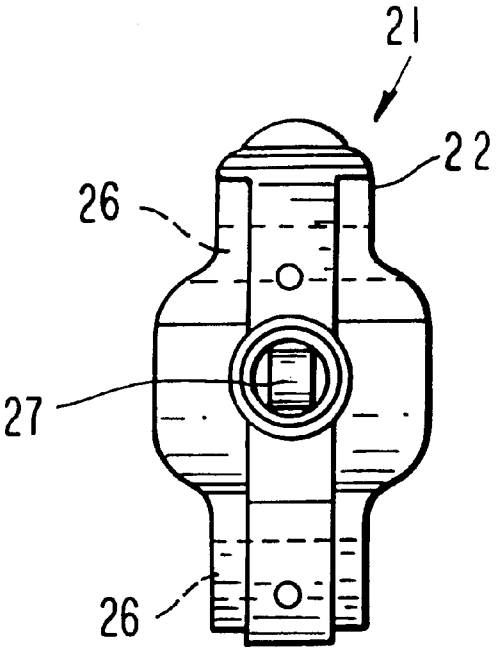

A power tool in accordance with the present invention has one first housing unit which is identified as a whole with reference numeral 1 as show in FIGS. 1 and 2. The housing unit 1 has a housing 2, a cam mechanism including a cam 3 rotatable in the housing around an axis A1 and formed for example as a double cam, a cam roller 4, a driving member 5 which is formed for example as a cam rod and displaced during turning of the cam 3 through the roller 4, and a guide ring 6. A compression spring 7 located in a spring sleeve 8 operates as a return spring. The housing 2 has connecting means 9, while the cam rod 5 has connecting means 10 formed for example as openings. The cam 3 is provided with connecting means 11 formed for example as a polygonal (square) projection or opening. The connecting means 11 can be engaged by an additional tool, such as for example a manual torque tool, a cheater bar, a manual multiplier, an air wrench, an electric wrench, an electric multiplier, an impact wrench, etc. which customer has in his possession so as to turn the cam 3.

The power tool has another first housing unit which is identified as a whole with reference numeral 21. The housing unit 21 has hydraulically operated drive means including a housing 22 which forms a hydraulic cylinder with a piston 23 reciprocatingly movable in it, and a driving element which is formed as a piston rod 24 connected with the piston 23. Hydraulic fluid is supplied to opposite chambers formed by the piston 23 in the cylinder 22 through hydraulic connecting elements 25 which are connected to a not shown hydraulic fluid source. The housing 22 is provided with connecting means which are formed as openings 26. The driving element or the piston rod 24 is also provided with connecting means 27 which can be also formed as an opening.

Figure 5:
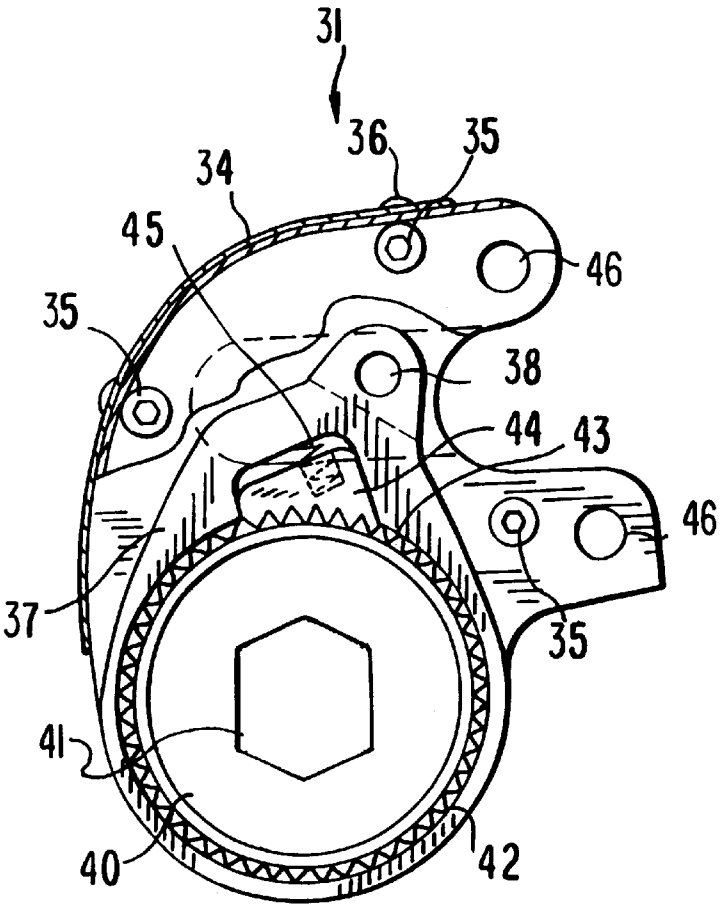
FIGS. 5 and 6 are a side view and an end view of one second unit of the inventive power tool.
Figure 6:
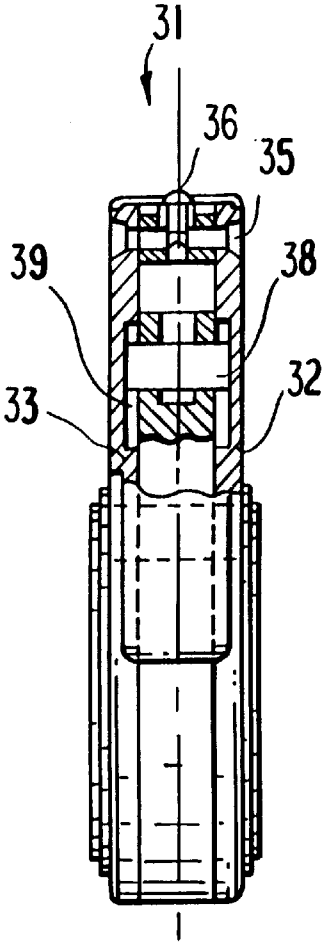

The power tool further has one second housing unit which is identified as a whole with reference numeral 31 and shown in FIGS. 5 and 6. The housing unit 31 has a housing which is composed of two housing plates 32 and 33 and a cover 34. The housing plates 32 and 33 are connected with one another by rivets 35, and the cover 34 is connected to the cover plate 32 and 33 also by rivets 36. The housing unit 31 is further provided with a drive lever 37 which is turnably received in the plates 32 and 33 through a pivot pin 38 which is movable in grooves 39 provided in facing surfaces of the plates. A ratchet mechanism includes a ratchet 40 which is arranged turnably in the lever 37 and has an inner engaging formation 41 which is formed for example as a hexagonal opening, a hexagonal shaft, etc. The ratchet 40 has outer teeth 42 which are engageable with teeth 43 of a pawl 44. The pawl 44 is slidingly received in an opening of the drive lever 37 and spring biased by a spring 45 toward the ratchet 40. The housing or in particular the plates 32 and 33 are provided with connecting means which include openings 46.

Figure 7:
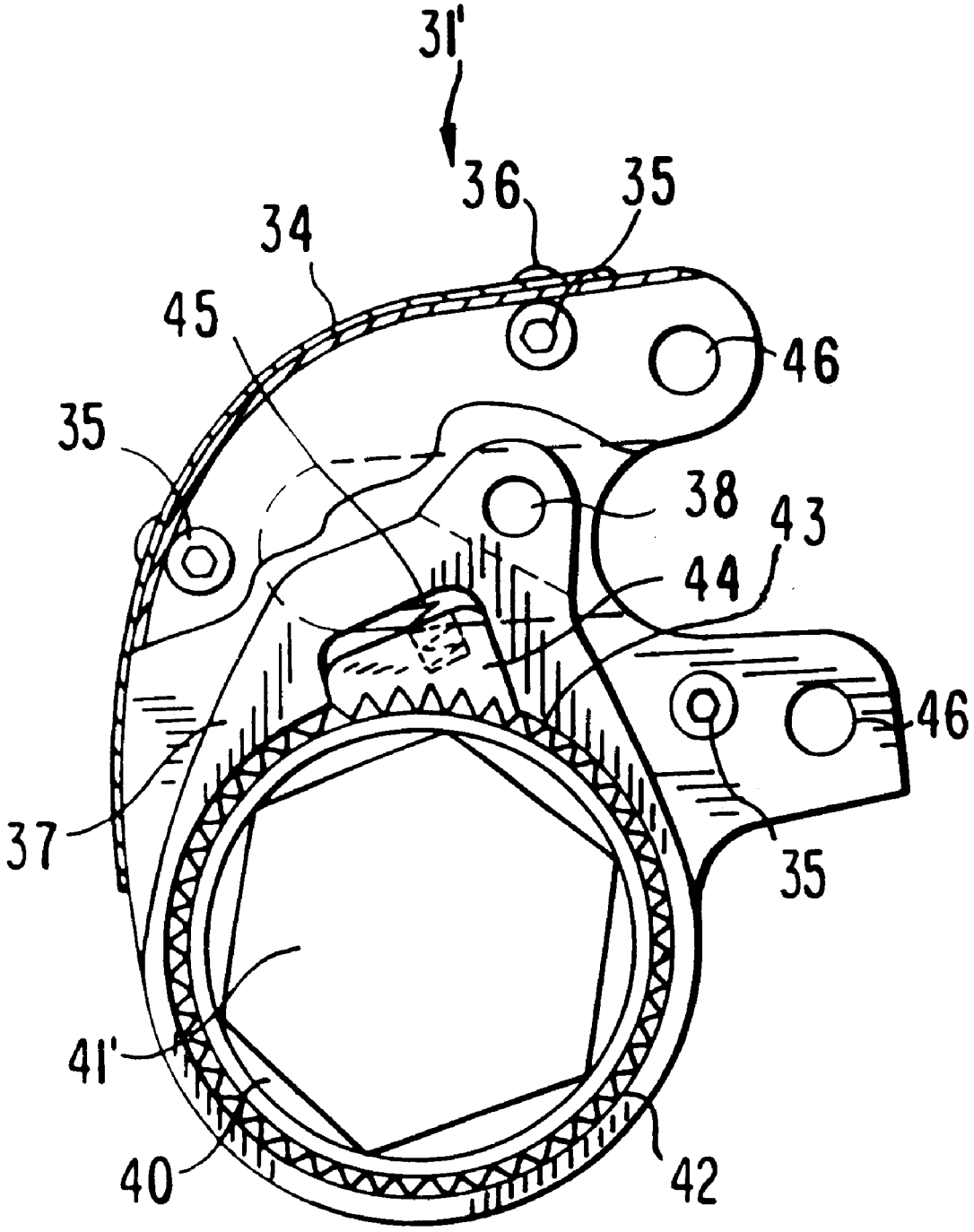
FIG. 7 is a side view of another second unit of the inventive power tool.

Finally, the power tool has another second housing unit which is identified as a whole with reference numeral 31' and shown in FIG. 7. The other second housing 31' is substantially similar to the one second housing unit 31, and therefore the parts of the housing unit 31' which are similar to the parts of the housing unit 31 are identified with the same reference numerals. The other second housing unit 31' differs from the one second housing unit 31 for example by the engaging means with which it engages a threaded connector to be tightened and loosened. For example as shown in FIG. 5 the engaging means in the one second housing unit 31 is formed as a hexagonal opening of a predetermined size. In the other second housing unit 31' the engaging means can be also formed as a hexagonal opening 41', but of a different size so as to engage and turn nuts, bolts, etc. of different sizes.

Figure 8:
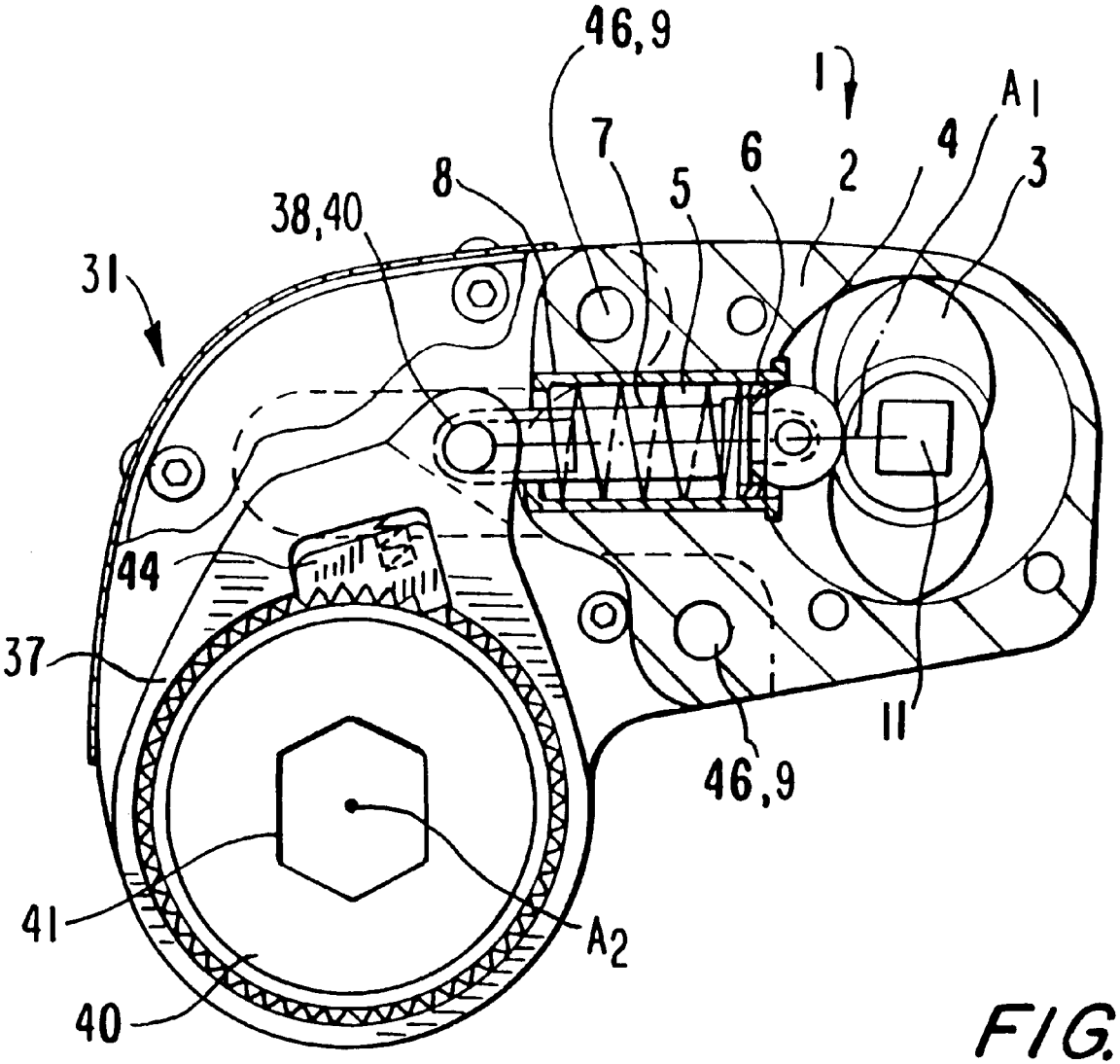
FIG. 8 is a view showing a power tool in accordance with the present invention which includes one first unit and one second unit.

When for example it is necessary to use a power tool in limited clearance areas, with a higher torque output, etc., then the one first housing 1 is assembled with the one second housing unit 31 by simply introducing corresponding fasteners into the aligned openings 46, 9 and 38, 10 as shown in FIG. 8. During the operation when the cam 3 is rotated around its axis it imparts a movement to the driving member 5 along a first axis A1 of the one first housing 1, the drive lever 37 located in the one second housing unit 31 is turned, and as a result the pawl 44 turns the ratchet 40, which in turn through the hexagonal opening 41 turns a threaded connector engaged in the hexagonal opening around a second axis A2 which is perpendicular to the first axis A1.

Figure 9:
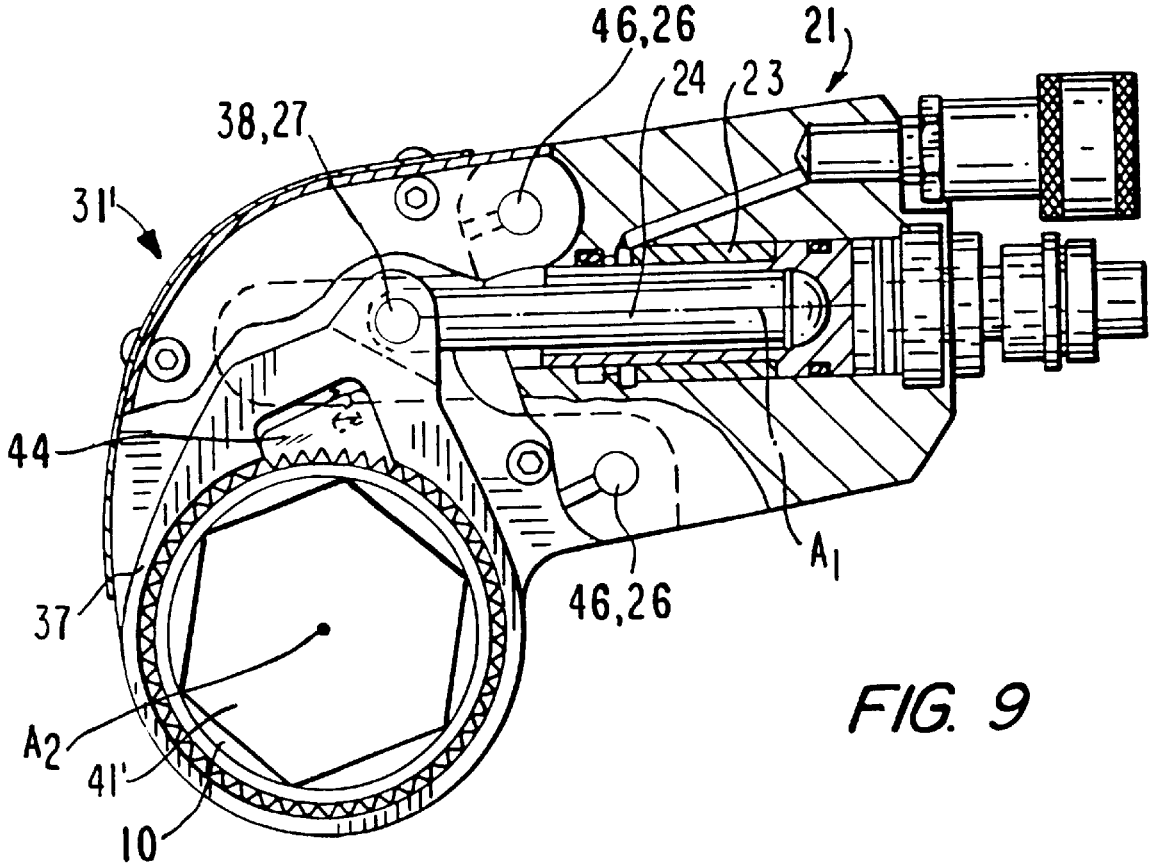
FIG. 9 is a view showing a power tool in accordance with the present invention which includes the other first unit and the other second unit.

When it is necessary to use a tool not in limited clearance area, with a lower torque, a higher output power, etc., the other first housing unit 21 is connected with the other second housing unit 31' as shown in FIG. 9, by inserting fasteners into the aligned openings 46, 26 and 38, 27. When the pressurized fluid is admitted into the cylinder 23, it displaces the piston with the piston rod 24 along the axis Al, so that the drive lever 37 located in the other second housing unit 31' is turned, and as a result the pawl 44 turns the ratchet 44 and thereby a threaded connector engaged in a hexagonal opening 41' of the ratchet around the axis A2 which is perpendicular to the axis Al.

It is believed to be clear that when the lever-ratchet mechanism is moved forward or backward under the action of the displacement of the driving member 5 of the housing unit 1 or the piston rod 24 of the housing unit 21 along the first axis A1, a fastener engaged in the engaging element, for example in the hexagonal opening 41, 41' is ratcheted in a single turning direction.

The connecting means which connect the first housing unit with the second housing units and include in the shown example openings to be aligned with one another and fasteners to extend through the thusly aligned openings, are formed so that they provide quick connection to permit in-field exchange of either housing according to the requirements on hand. It is believed to be clear that the other quick connection means can be used, for example bajonet locks, etc.

It is also believed to be clear that the power tool in accordance with the present invention can have more than two first housings and more than two second housings connectable correspondingly with one another, for tightening and loosening of threaded connectors for corresponding applications.

It will be understood that each of the elements described above, or two or more together, may also find a useful application in other types of constructions differing from the types described above.

While the invention has been illustrated and described as embodied in universal power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A universal power tool, comprising two interchangeable first housing units having a first axis; two interchangeable second housing units, one of said two first housing units having a cam mechanism to be turned by an outside power source, the other of said two first housing units having a cylinder-piston arrangement with a piston rod movable by fluid power, each of said two second housing units having a lever-ratchet mechanism, different engaging means for engaging a threaded connector to be tightened or loosened, and also having a second axis perpendicular to said first axis; means for interchangeably connecting one of said two second housing units to one of said two first housing units, so that upon rotating said cam of said one of said two first housing units in one direction said cam mechanism imparts a movement along said first axis, and upon moving a piston of said other of said two first housing units a piston rod imparts a movement along said first axis, each of said movements along said first axis being applied to said lever-ratchet mechanism to make one end of a lever to move along said first axis and another end of said lever to turn around said second axis, and thereby when said cam is turned by an outside tool or said piston rod is moved along said first axis by fluid power, said lever-ratchet mechanism is moved forward and backward to ratchet the fastener in a single turning direction.

2. A power tool as defined in claim 1, wherein said engaging means of said at least two second housing units are formed to directly connect two threaded fasteners of different sizes.

3. A power tool as defined in claim 2, wherein said engaging means of at least two second housing units are formed to directly connect to a hexagonal or 12 point nut of different sizes.

4. A power tool as defined in claim 1, wherein said connecting means are formed so that said first housing units and said second housing units are quick connectable to permit in-field exchange of either of said housing unit according to requirements on hand.

* * * * *